United States Patent [19]

Fitzpatrick et al.

[11] 4,151,438

[45] Apr. 24, 1979

[54] DISTRIBUTED ELECTRICAL LEADS FOR THERMIONIC CONVERTER

[75] Inventors: Gary O. Fitzpatrick, Livermore; Edward J. Britt, Cupertino, both of Calif.

[73] Assignee: The United States of America as represented by United States Department of Energy, Washington, D.C.

[21] Appl. No.: 825,518

[22] Filed: Aug. 17, 1977

[51] Int. Cl.[2] ..... H01J 45/00
[52] U.S. Cl. ..... 310/306
[58] Field of Search ..... 310/306

[56] References Cited

U.S. PATENT DOCUMENTS

| | | | |
|---|---|---|---|
| 3,312,840 | 4/1967 | Gabor | 310/306 |
| 3,439,193 | 4/1969 | Beusussan | 310/306 |
| 3,515,408 | 6/1970 | Caldwell | 310/306 |
| 3,843,896 | 10/1974 | Rasor et al. | 310/306 |

*Primary Examiner*—Donovan F. Duggan
*Attorney, Agent, or Firm*—Dean E. Carlson; Frank H. Jackson; Paul A. Gottlieb

[57] ABSTRACT

In a thermionic converter, means are provided for coupling an electrical lead to at least one of the electrodes thereof. The means include a bus bar and a plurality of distributed leads coupled to the bus bar each of which penetrates through one electrode and are then coupled to the other electrode of the converter in spaced apart relation.

6 Claims, 3 Drawing Figures

FIG-1
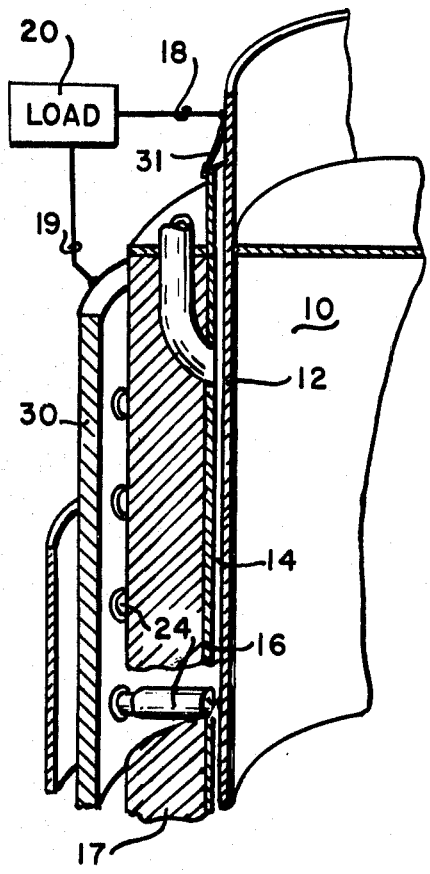
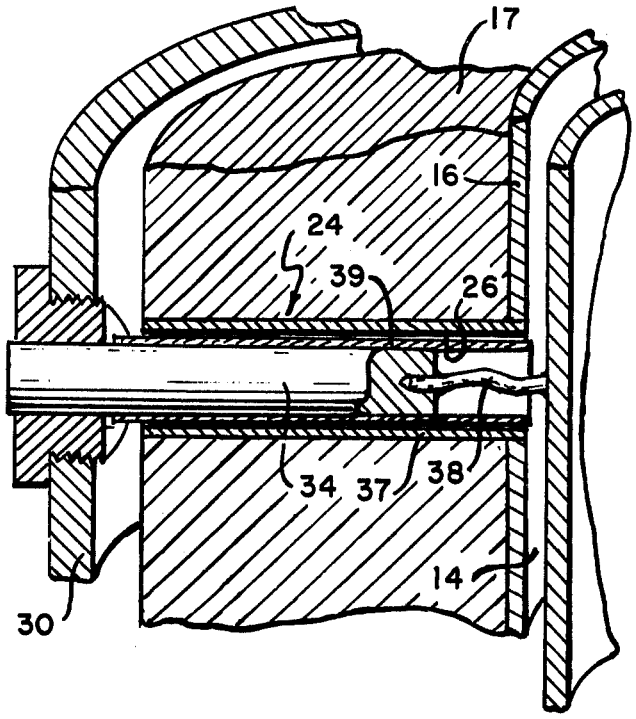
FIG-2
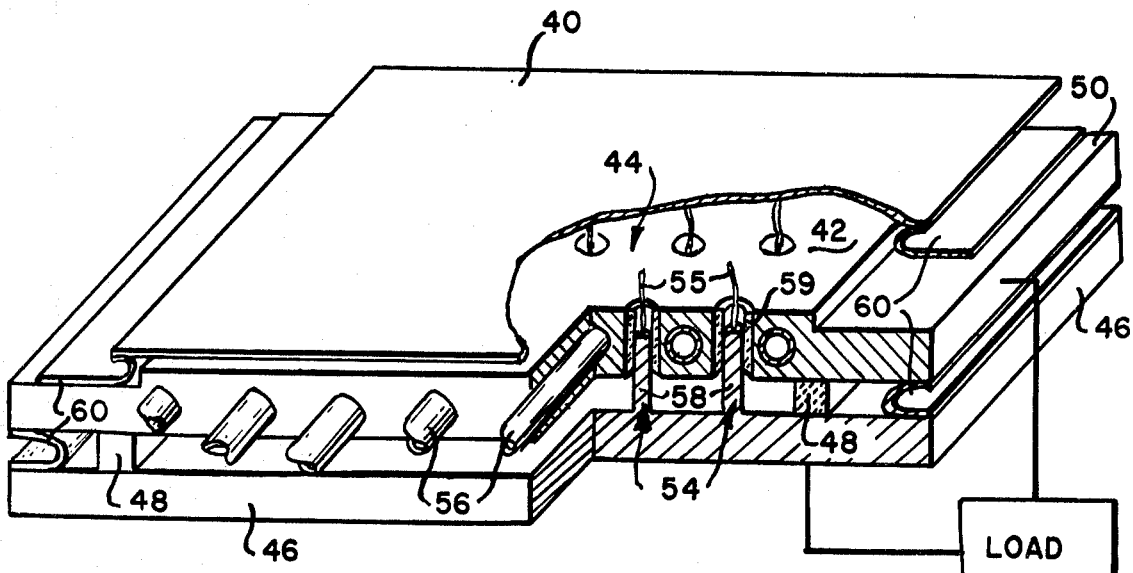
FIG-3

DISTRIBUTED ELECTRICAL LEADS FOR THERMIONIC CONVERTER

CONTRACTUAL ORIGIN OF THE INVENTION

The invention described herein was made in the course of, or under, a contract with the UNITED STATES ENERGY RESEARCH AND DEVELOPMENT ADMINISTRATION.

BACKGROUND OF THE INVENTION

Previous designs for thermionic converters have all used single current carrying leads as connections to the emitter and collector electrodes. To be removed the total current of each converter cell must flow through the electrodes at the location of the electrical leads. As converter cell design is growing larger, large electrode areas are constructed and the large currents which flow in the electrodes present problems in the form of ohmic losses and magnetic fields. Large currents require thick electrodes to minimize electrical losses. These electrodes are expensive, particularly at emitter temperatures where material resistance is high and refractories are needed. Thick electrodes result in large temperature drops across the electrodes, giving higher peak temperatures and greater stresses. Large currents in the electrode produce a large magnetic field in the gap which causes the electrons in the plasma to travel in curved paths and thereby reduces the current reaching the collector. At present these defects limit converter size and geometry. Large currents in a converter are desirable because they permit the use of high resistance, metallic closures instead of ceramic metal seals.

It is therefore an object of this invention to provide an improved thermionic converter.

Another object of this invention is to provide an improved means of coupling electrical leads to the electrodes of thermionic converters.

SUMMARY OF THE INVENTION

In a thermionic converter having emitter and collector electrodes, there is provided an improvement in coupling electrical leads to the electrodes. A main bus bar is provided and is positioned so that one electrode is between the bus bar and the other electrode. A plurality of electrical leads extend from the bus bar and penetrate through the one electrode and are then coupled to the other electrode. This distributed lead concept which requires the spaced apart relationship between these electrical leads is applicable both to cylindrical and planar converter designs.

BRIEF DESCRIPTION OF THE DRAWINGS

FIG. 1 shows a cylindrical, thermionic converter with distributed leads;

FIG. 2 is a cross section showing an individual distributed lead; and

FIG. 3 shows a planar thermionic converter with distributed leads.

DETAILED DESCRIPTION OF THE PREFERRED EMBODIMENT

Referring to FIG. 1 there is shown a cylindrical, thermionic converter. The converter includes a heat source region 10 where heat is supplied to an electrode, the emitter 12, from which electrons are thermionically emitted into the main gap 14. The heat source may be, for example, a nuclear reactor fuel element, hot liquid metal flowing in a tube, heat pipe or other means able to raise the temperature of emitter 12 to that necessary to cause the emission of electrons. The electrons so emitted move across the main gap towards another electrode, the collector 16, which is at a lower temperature than the emitter 12 since it is not directly heated by heat source region 10 and is cooled by a heat sink 17. At the collector 16 the electrons condense and return to emitter 12 via leads 18 and 19 and load 20 connected between collector 16 and emitter 12. The flow of electrons from emitter 12 to collector 16 is maintained by the temperature difference between them, which occurs because emitter 12 is being heated. Thus, an electrical current is generated in load 20 by heat applied to emitter 12. Prior art practice has been to couple the leads 18 and 19 to one end of each electrode or at a single location of each particular electrode. For large area electrodes, problems arise which limit the ultimate size of the converter due to this type of coupling. There is herein disclosed a means of providing the coupling between the emitter and collector, which is applicable to coupling either to the collector or to the emitter. Since the emitter operates at such a high temperature, the size limiting effects previously described are more pronounced with the emitter so that in the preferred embodiment such coupling is made to the emitter.

As shown in FIG. 1 the large area emitter 12 is attached to a number of small distributed electrical leads 24 which penetrate the collector 16 through a plurality of spaced holes 26 in collector 16. After penetration of collector 16, each lead 24 is coupled to a main bus bar 30. Therefore, current in the emitter electrode 12 does not have to flow the total distance to either edge of itself to be removed. Instead, the current flows to the nearest of the distributed electrical leads 24 and then to a large low resistance bus bar 30. Each of the regions of small cross section in the distributed leads 24 is designed as an optimum lead to give the proper voltage and temperature drop for maximum converter performance. The maximum distance which current must flow in emitter 12 is only one-half the distance between the small leads 24 and therefore the maximum current in any portion of the emitter is reduced. Thus the emitter 12 may be much thinner than prior art practice, reducing peak system temperatures and stresses, and perhaps eliminating the need for liquid metals at high emitter temperatures. The bus bar 30 operates at low temperature, even below that of the collector. Consequently, it may be made of less refractory materials than the emitter and optimized for cost and resistance characteristics. A thin high resistance metal closure (31) is used to seal the converter.

In the embodiment shown in FIG. 1, the bus bar 30 is in the form of a cylinder and is provided with seals 31 at the top and bottom (not shown) to ensure that the proper atmosphere is maintained in the main gap 14. Copper is a satisfactory material for bus bar 30. The penetration by electrodes 24 through collector 16 via holes 26 should be such that the leads 24 are insulated from collector 16 and so that the coupling of leads 24 to emitter 12 takes into account the high temperature of emitter 12. Referring to FIG. 2 there is shown one method of accomplishing this which is to provide a main section 34 extending from bus bar 30 into hole 26. Atop this main section is a thin section foil 38 which is directly coupled to emitter 16. Alternately atop the main section could be a thinner rigid section of high refractory material. A thin foil has the advantage of being flexible to adapt to any shifts in part position. Molybdenum or niobium are satisfactory refractory metals to withstand typical emitter temperatures of 1500°-2000° K. Copper can be used for bus bar 30 and main section 34.

Insulation of the main lead 34 from the collector 16 can be maintained either by use of a ceramic, electrical feedthrough or by the proper maintaining of the separation between the walls of hole 26 and each lead 24. If section 38 is rigid, then the distributed leads 24, not only couple the emitter but also contribute to maintaining the proper spacing between electrodes 12 and 16 to ensure that gap 14 is maintained at the proper spacing throughout the length of the converter. The lead 24 may be coupled to the emitter by well known techniques such as welding, brazing, etc. In the embodiment shown in FIG. 1 and FIG. 2 lead 24 is insulated from collector 16 by an insulating sleeve 39 which could, for example, be of alumina. In addition a sleeve 37 is shown penetrating heat sink 17 since heat sink 17 may contain a liquid.

Referring to FIG. 3 there is shown an alternate embodiment wherein the thermionic converter shown is a planar thermionic converter. In this embodiment, the emitter 40 and the collector 44 are flat sheets. The source of heat is applied to the exposed side of emitter 40. The bus bar 46 is then also formed in a flat sheet and may be separated from the collector 44 by ceramic spacers 48. The collector is provided with its own main bus bar 50 which is coupled to the emitter bus bar 46 across a load 52. The distributed leads 54 penetrate the planar collector 44 in a manner similar to that described for the embodiment of FIG. 1. In this embodiment top portion 55 of each lead 54 which must contact the flat emitter 40 is in the form of a foil welded to the emitter 40 and coupled to the top of main portion 58 of lead 54. A ceramic insulator 59 separates the lead 54 from collector 44. A flexible electrode would provide easier assembly than a rigid electrode and be less likely to break under stress. In this embodiment, the collector 44 is provided with a heat removal system 56 which consists of a group of conduits extending through the conductor through which a coolant may be sent. Sealing is provided by thin metal seals 60 between the plates. These seals 60 may be welded to each element. Alternatively, the bulk metal seals, such as 60, could be replaced by individual seals at each distributed leads 54 to prevent leakage of gas from the gap 42. However, this would probably increase fabrication costs. As in FIG. 1 the whole assembly could be contained within a metal box formed by the collector bus bar 46. Alternately, a group of bus bars could be utilized instead of the single plate thereby possibly reducing metal costs although fabrication costs would rise accordingly. No large magnetic fields are created in the inner electrode space with this design. A localized magnetic field surrounds each of the distributed electrical leads. The magnitude and dimensions of this field depend on the geometery and spacing between the distributed leads. It is possible to arrange the distributed leads so that the localized magnetic field does not severely perturb converter performance.

While the most probable design for distributed lead converter is with the emitter attached to the distributed leads, as shown in Figures, it is possible to interchange the rolls of the electrodes and have the collector attached to the distributed leads. It is also possible to provide penetrations of the external bus bar and attach both electrodes to the distributed leads. The number of leads which will give optimum performance at minimum fabrication cost is a matter of design choice.

The embodiments of the invention in which an exclusive property or privilege is claimed are defined as follows:

1. In a thermionic converter, the improvement for making an electrical connection with one of the electrodes thereof, comprising:

A one piece large area electrode, a one piece large area emitter electrode, a main bus bar positioned so that one of said electrodes is between said bus bar and the other of said electrodes, a plurality of distributed leads coupled to said bus bar at spaced apart locations and each lead penetrating through said one electrode at spaced apart locations and being coupled to said other electrode at spaced apart locations, each of said leads including a thick section extending from said bus bar and a flat flexible thin section coupled between said thick section and said other electrode.

2. The converter of claim 1 wherein said other electrode is the emitter electrode and said one electrode is the collector electrode.

3. The converter of claim 2 wherein each of said leads includes an insulator for insulating said lead from the collector which each of said leads penetrate.

4. The converter of claim 3 further including seals between the emitter and collector for insolating the gap therebetween.

5. The converter of claim 4 wherein the emitter and the collector are cylindrical.

6. The converter of claim 4 wherein the emitter and the collector are planar.

* * * * *